US007915985B2

(12) United States Patent
Schmitz et al.

(10) Patent No.: US 7,915,985 B2
(45) Date of Patent: Mar. 29, 2011

(54) SWITCHING DEVICE FOR DIRECT-CURRENT APPLICATIONS

(75) Inventors: Gerd Schmitz, Niederkassel (DE); Volker Lang, Bonn (DE); Wolfgang Kremers, Bonn (DE); Lothar Winzen, Unkel (DE)

(73) Assignee: Eaton Industries GmbH, Bonn (DE)

( * ) Notice: Subject to any disclaimer, the term of this patent is extended or adjusted under 35 U.S.C. 154(b) by 187 days.

(21) Appl. No.: 12/271,562

(22) Filed: Nov. 14, 2008

(65) Prior Publication Data

US 2009/0127229 A1 May 21, 2009

(30) Foreign Application Priority Data

Nov. 17, 2007 (DE) ..... 10 2007 054 958

(51) Int. Cl.

| | |
|---|---|
| ***H01H 9/30*** | (2006.01) |
| ***H01H 9/02*** | (2006.01) |
| ***H01H 13/04*** | (2006.01) |
| ***H01H 9/44*** | (2006.01) |
| ***H01H 33/18*** | (2006.01) |

(52) U.S. Cl. ..... 335/201; 335/202; 218/22; 218/23; 218/24; 218/25; 218/26; 218/34

(58) Field of Classification Search ..... 335/201–202; 218/22–26, 34–42, 104, 141

See application file for complete search history.

(56) References Cited

U.S. PATENT DOCUMENTS

| | | | | |
|---|---|---|---|---|
| 2,332,446 | A * | 10/1943 | Heinrich | 218/26 |
| 2,575,060 | A * | 11/1951 | Matthias | 218/25 |
| 2,875,304 | A * | 2/1959 | White | 218/26 |
| 4,004,260 | A * | 1/1977 | Happach | 335/202 |
| 4,048,600 | A * | 9/1977 | Dietrich | 335/128 |
| 4,367,448 | A | 1/1983 | Nishizako | |
| 4,404,443 | A * | 9/1983 | Coynel et al. | 218/23 |
| 4,962,406 | A | 10/1990 | Walker et al. | |
| 5,004,874 | A * | 4/1991 | Theisen et al. | 218/151 |
| 5,416,455 | A * | 5/1995 | Moldovan et al. | 335/132 |

(Continued)

FOREIGN PATENT DOCUMENTS

| | | |
|---|---|---|
| DE | 1874564 | 6/1963 |

(Continued)

OTHER PUBLICATIONS

European Search Report for EP 08 01 9482, mailed on Jan. 18, 2010.

*Primary Examiner* — Elvin G Enad
*Assistant Examiner* — Mohamad A Musleh
(74) *Attorney, Agent, or Firm* — Leydig, Voit & Mayer, Ltd.

(57) ABSTRACT

A switching device for direct-current applications includes a housing having a first wall and a second wall, a plurality of receiving areas for respective mutually substantially parallel current paths disposed in the housing. Each of the current paths has a respective stationary switching contact element and a respective movable switching contact element, the movable switching element being actuatable into a closed position and into an open position so as to form a respective air break, the respective movable switching contact elements being actuatable simultaneously. The switching device includes a plurality of arc-quenching devices associated with the current paths and disposed next to each other, and at least one magnet. The at least one magnet is configured to generate a magnetic field so as to generate a deflection force on the arcs so as to deflect the respective arcs toward at least one of the respective arc-quenching devices.

16 Claims, 4 Drawing Sheets

U.S. PATENT DOCUMENTS

| | | | | |
|---|---|---|---|---|
| 5,546,061 | A * | 8/1996 | Okabayashi et al. | 335/78 |
| 6,700,466 | B1 * | 3/2004 | Yamamoto et al. | 335/132 |
| 7,145,422 | B2 * | 12/2006 | Imanishi et al. | 335/201 |
| 7,157,996 | B2 * | 1/2007 | Enomoto et al. | 335/132 |
| 2008/0030289 | A1 * | 2/2008 | Kralik | 335/201 |

FOREIGN PATENT DOCUMENTS

| | | |
|---|---|---|
| DE | 1884948 | 12/1963 |
| DE | 1246851 B | 8/1967 |
| DE | 340964 | 9/1984 |
| DE | 4342129 | 6/1995 |
| DE | 10212948 | 11/2002 |
| DE | 10352934 | 6/2005 |
| DE | 202005007878 | 9/2006 |
| EP | 098085 | 1/1984 |
| EP | 0217106 | 4/1987 |
| EP | 601941 | 6/1994 |
| EP | 1594148 | 11/2005 |

* cited by examiner

SWITCHING DEVICE FOR DIRECT-CURRENT APPLICATIONS

CROSS REFERENCE TO PRIOR APPLICATIONS

Priority is claimed to German Patent Application No. 10 2007 054 958.1, filed Nov. 17, 2007, the entire disclosure of which is incorporated by reference herein.

FIELD

The present invention relates to a switching device for direct-current applications, which is built employing components of switching devices for alternating-current applications such as, for example, safety cutouts, circuit-breakers, load-break switches and residual-current protectors.

BACKGROUND

In order to switch off short-circuit currents in secondary distribution systems, for the most part switching devices are employed that have one or more current paths which, in turn, encompass stationary and movable switching contact elements. Here, the movable switching contact elements can be jointly moved between a closed position, in which the movable and stationary switching contact elements that are associated with each other make contact with each other, and an open position, in which an air break is formed between each of the movable and stationary switching contact elements that are associated with each other. As soon as the movable switching contact elements are moved under load—that is to say, are moved under a current flow—into the open position, (breaking) arcs are created along the air breaks. The duration of the arcs determines the switching time since the current flow between the switching contact elements is maintained. Moreover, the arcs release a large quantity of heat that leads to thermal destruction of the switching contact elements and thus to a shortening of the service life of the switching device. Consequently, there is a need to quench the arcs as quickly as possible, which can be done by arc-quenching devices such as, for example, arc splitters, arc-quenching plates or deion plates. These quenching devices split the arcs into individual partial arcs; the arcs are reliably quenched when the arc voltages are higher than the driving voltages.

For alternating-current applications, the quenching of the arcs is facilitated in that the current has a natural zero passage. When high (short-circuit) currents have to be switched off, however, an arc-back can occur after the zero passage; however, the arcs formed at high currents, in turn, create such a large self-magnetic field that they are automatically deflected towards the arc-quenching devices and are ultimately quenched.

When it comes to switching devices for direct-current applications, no automatic interruption of the arc occurs as is the case with the zero passage of alternating current. Consequently, for direct-current applications, so-called blow-out magnets are employed that generate a magnetic field whose strength and orientation exert a deflecting force (Lorentz force) on the arcs, thus deflecting the arcs towards the arc-quenching devices. The arcs are stretched, cooled and split into partial arcs in the arc-quenching devices, as a result of which they are quenched.

Switching devices of the above-mentioned type for alternating-current applications are described, for example, in DE 103 52 934 B4, DE 102 12 948 B4, DE 20 2005 007 878 U1, EP 1 594 148 A1, EP 0 980 085 B1 and EP 0 217 106 B1.

Typically, a distinction is made between alternating-current and direct-current switching devices. Whereas alternating-current switching devices of the one-pole or multi-pole type can be produced inexpensively in large quantities, direct-current switching devices in the form of one-pole or two-pole switching devices are manufactured in considerably smaller production runs. Consequently, direct-current switching devices, some with a prescribed direction of incoming supply, are special devices. The use of renewable sources of energy such as, for instance, solar energy, fuel cells, battery series and so forth calls for more switching devices that have a direct-current switching capability as well as an isolating function in the low and medium current ranges at voltages of up to about 1000 V.

SUMMARY

The present invention is directed to cost-effectively producing switching devices with a direct-current switching capability and a direct-current isolating function.

In an embodiment, the present invention provides a switching device for direct-current applications. The switching device includes a housing having a first wall and a second wall disposed opposite each other and a plurality of receiving areas for respective mutually substantially parallel current paths, the receiving areas being disposed next to each other in the housing between the first and second walls. Each of the current paths has a respective stationary switching contact element and a respective movable switching contact element, the movable switching element being actuatable into a closed position so that the movable switching element is in contact with the respective stationary switching contact, and into an open position so as to form a respective air break so that an arc extending along the air break is formable, the respective movable switching contact elements being actuatable simultaneously between the open position and the closed position. The switching device includes a plurality of arc-quenching devices associated with the current paths and disposed next to each other between the first and the second walls, and at least one magnet disposed on an outside of at least one of the first and second walls. The at least one magnet is configured to generate a magnetic field having magnetic field lines in a direction crosswise to the respective air breaks so as to generate a deflection force on the arcs so as to deflect the respective arcs toward at least one of the respective arc-quenching devices.

BRIEF DESCRIPTION OF THE DRAWINGS

The present invention is described in greater depth below on the basis of several embodiments and making reference to the drawings. In the figures.

DETAILED DESCRIPTION

Figure 1:
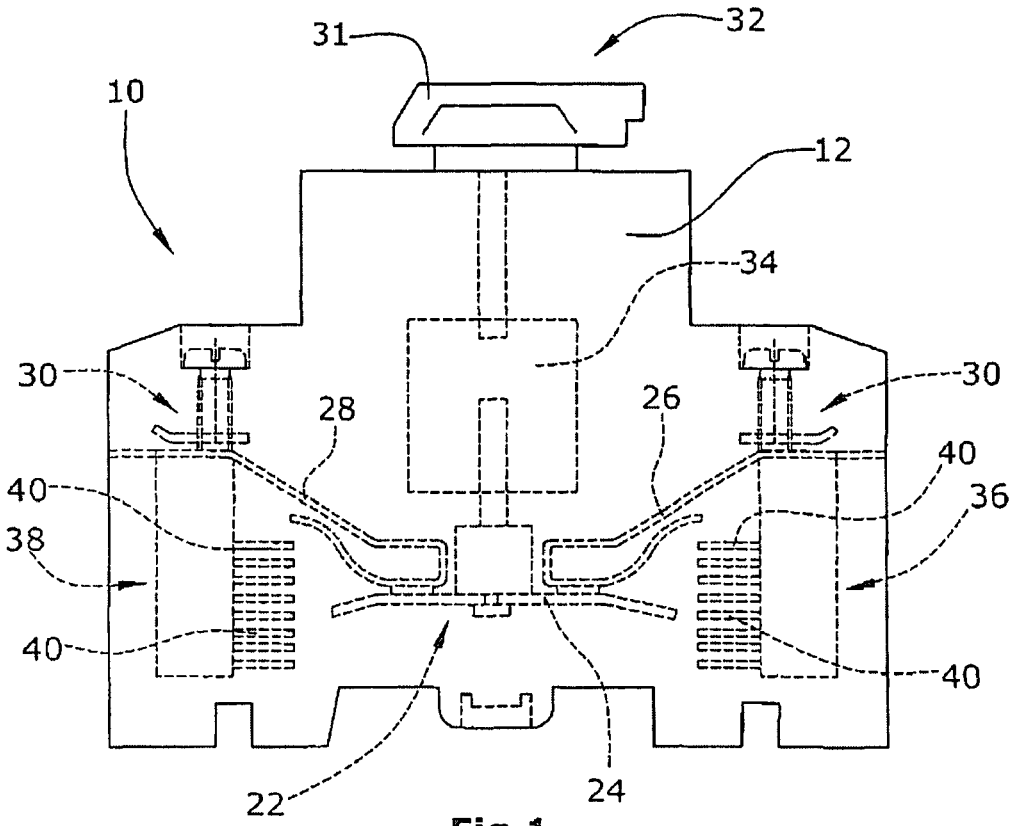
FIG. 1 shows a side view of a three-pole alternating-current switching device housing with movable switching contact elements in their closed position in accordance with an aspect of the present invention.

An embodiment of the present invention provides a switching device for direct-current applications that is provided with

- a housing having two side walls situated opposite from each other,
- at least three receiving areas for current paths that are essentially parallel to each other and that have air breaks, whereby the receiving areas are arranged next to each other in the housing between its side walls, and at least two of the receiving areas are each provided with a current path, and each current path has at least one stationary switching contact element and one movable switching contact element that can be moved into a closed position in order to contact the stationary switching contact element and into an open position in order to form the air break, and in said open position, an arc extending along the air break can be formed, whereby all of the movable switching contact elements can be moved together out of their open position into their closed position and vice versa,
- arc-quenching devices that are associated with the current paths and that are likewise arranged next to each other in the housing between its two side walls, and
- at least one magnet, preferably a permanent magnet, arranged on the outside of at least one of the side walls, having a magnetic field with field lines that extend essentially crosswise to the air breaks and with an orientation for generating deflection forces that act upon the arcs and that drive them into the arc-quenching devices.

According to another embodiment of the present invention, a switching device for direct-current applications is put forward that is provided with

- a housing having two side walls situated opposite from each other,
- at least three receiving areas for current paths that are essentially parallel to each other and that have air breaks, whereby the receiving areas are arranged next to each other in the housing between its side walls, and at least two of the receiving areas are each provided with a current path, and each current path has at least one stationary switching contact element and one movable switching contact element that can be moved into a closed position in order to contact the stationary switching contact element and into an open position in order to form the air break and, in said open position, an arc extending along the air break can be formed, whereby all of the movable switching contact elements can be moved together out of their open position into their closed position and vice versa,
- whereby at least one of the receiving areas is free of a current path and free of at least the movable switching contact element,
- arc-quenching devices that are associated with the current paths and that are likewise arranged next to each other in the housing between its two side walls,
- at least one magnet, preferably a permanent magnet, arranged in the at least one free receiving space, having a magnetic field with field lines that extend essentially crosswise to the air breaks and with an orientation for generating deflection forces that act upon the arcs and that drive them into the arc-quenching chambers.

Yet another embodiment of the present invention provides a switching device for direct-current applications that is provided with

- a housing having two side walls situated opposite from each other,
- at least three receiving areas for current paths that are essentially parallel to each other and that have air breaks, whereby the receiving areas are arranged next to each other in the housing between its side walls and at least two of the receiving areas are each provided with a current path, and each current path has at least one stationary switching contact element and one movable switching contact element that can be moved into a closed position in order to contact the stationary switching contact element and into an open position in order to form the air break and, in said open position, an arc extending along the air break can be formed, whereby all of the movable switching contact elements can be moved together out of their open position into their closed position and vice versa,
- arc-quenching devices that are associated with the current paths and that are likewise arranged next to each other in the housing between its two side walls, and
- in the housing, receiving spaces for magnetic-field amplifying elements—formed on both sides of the pairs having a movable and a stationary switching contact element—for amplifying the self-magnetic field of an arc formed along the air break,
- whereby a magnet, preferably a permanent magnet, having a magnetic field with field lines that extend essentially crosswise to the air breaks and with an orientation for generating deflection forces that act upon the arcs and that drive them into the arc-quenching devices is arranged in at least one of the receiving spaces.

The above-mentioned embodiments of the switching device according to the present invention for direct-current applications share the notion of utilizing the housing of a switching device for alternating-current applications for the production of the switching device in order to adapt this housing to the direct-current application in a manner that is simple and involves little effort. This means that the housing of the switching device for alternating-current applications has to be augmented by a magnet, preferably a permanent magnet. This magnet can be arranged either on the outside of the housing or else integrated into one of the at least three receiving areas for the current paths, whereby then, the appertaining receiving area is free of the movable switching contact element, or else it is integrated into a special receiving space of the housing of the switching device for alternating-current applications, in which normally a magnetic-field amplifying element is accommodated in order to amplify the self-magnetic field of the arc.

A feature of the switching device according to the present invention for direct-current applications lies in the fact that the introduction of internal or external magnets, preferably permanent magnets, considerably increases the direct-current switching capability of conventional alternating-current switching devices. In this context, each air break and each arc-quenching device does not necessarily have to be associated with an individual magnet, as is the case with the prior-art direct-current switching devices.

In an embodiment of the switching device according to the present invention, there is at least one (external) magnet on the outside of at least one of the two side walls of the housing. It is advantageous if at least one external magnet is arranged on both side walls. The field lines of the external magnet(s) "penetrate" the side-by-side air breaks of the individual current paths inside the housing. The magnetic flux or the magnetic field that traverses the air breaks can be amplified by means of a magnetic return element to which the two magnets are coupled. All of these components (one or more external magnets as well as one or more magnetic return elements) can be arranged in a simple manner on the outside of the housing of the alternating-current switching device in order to improve its direct-current switching capability. Furthermore, when a housing of an alternating-current switching device is employed as the switching device for direct-current applications, it is possible to dispense with at least one of the current paths (and here especially at least one of the movable switching contact elements), as is necessary for the alternating-current application. The reason for this is that, whereas alternating-current switching devices are usually configured as three-pole or four-pole devices, at best two-pole versions are needed in the case of direct-current switching devices. Therefore, it is possible to dispense with the third or fourth current path for the construction of a direct-current switching device on the basis of a housing for an alternating-current switching device. This likewise reduces the production costs of the direct-current switching device. At the same time, however, it is also possible to retain the current paths of an alternating-current switching device housing and to connect at least two of the current paths in series for purposes of utilizing such a switching device possibly for purposes of a one-pole switch-off for direct-current applications employing several air breaks.

If at least one current path and especially at least one movable switching contact element is not present in the case of a three-pole or four-pole alternating-current switching device housing, then the corresponding receiving area of the switching device housing can be employed to accommodate the (blow-out) magnet or an additional (blow-out) magnet.

The switching devices according to the present invention can be configured as ON-OFF switching devices (so-called load interrupter switches) or else as safety cutouts or circuit-breakers which, going beyond a load interruptor switch, are provided with an additional functionality, namely, automatic detection and switch-off in the eventuality of a short-circuit current or the like.

FIGS. 1 to 4 show a first embodiment of a switching device 10 according to the present invention for direct-current applications that is constructed on the basis of a switching device for alternating-current applications. The switching device 10 has a switching device housing 12 in which three receiving areas 16, 18, 20 are arranged next to each other between two opposite (external) side walls 14, whereby a current path 22 is situated in each receiving space. Here, each current path 22 includes a movable switching contact element 24 as well as two stationary switching contact elements 26, 28 situated opposite from each other, which are each provided with terminals 30. The three movable switching contact elements 24 can be jointly moved between a closed position (see FIG. 1) and an open position (see FIG. 2), namely, by means of an actuator 32 configured in this embodiment as a knob switch 31 that interacts in a familiar manner with a breaker latching mechanism 34 for purposes of locking the movable switching contact elements 24 in their closed position and for jointly releasing the movable switching contact elements 24. In a familiar manner, two arc-quenching devices 36, 38—which are each configured in the form of individual quenching plates 40 arranged one above the other—are associated with the individual current paths 22. Moreover, each current path 22 has two air breaks 42, 43 that, when the movable switching contact elements 24 are opened, are formed between their ends and the first and second stationary switching contact elements 26, 28 associated with these ends (see FIG. 2). When the three-pole switching device 10 is opened under load, arcs are formed along these air breaks 42, 43, and these arcs have to be quenched by means of the arc-quenching devices 36, 38. Since, in the case of direct-current applications, the extinction of the arcs cannot be facilitated or achieved on the basis of the zero passage of the current, in order for the switching device 10 to be used for direct-current applications, first and second permanent magnets 44, 46 have to be provided which, in the embodiment shown in FIGS. 1 to 4, are arranged on the outside of the side walls 14 and held in place by disk-shaped holding elements 48, 50. Here, the first magnets 44 have a magnetic field with field lines that are oriented crosswise to the air breaks 42, 43 and that generate a Lorentz force onto arcs formed along these air breaks 42, 43, said force driving the arcs towards the first arc-quenching devices 36. The second external magnets 46, in turn, generate a magnetic field with field lines that are oriented crosswise to the second air breaks 43 and that generate a Lorentz force onto arcs formed along these air breaks 43, said force deflecting the arcs towards the second arc-quenching devices 38. In this context, the first magnets 44 are oriented towards the first air breaks 42, while the second magnets 46 are arranged as an extension of the second air breaks 43 that lie side by side. In this manner, the three-pole switching device 10 that was originally conceived for alternating-current applications can also be employed for direct-current applications, whereby its direct-current switch-off capability is markedly improved in comparison to the direct-current switching capability of an alternating-current switching device, without a need for any major design changes. Rather, all that is necessary is to arrange the above-mentioned magnets 44, 46 on the outside of the opposite external sides 14 of the housing 12 of the switching device 10, whereby it should be mentioned that, in each case, a single first or a second magnet is fundamentally needed for all of the first air breaks 42 and for all of the second air breaks 43. By the same token, it should also be mentioned at this juncture that, in order to realize the present invention, it is not absolutely necessary to provide a switching device 10 that has two air breaks per current path. The adaptation of an alternating-current switching device that is to be used for direct-current applications is also possible with alternating-current switching device housings that have only one single air break per current path 22, in other words, one movable switching contact element and one single stationary switching contact element per current path 22, so that then just one single magnet is needed for all of the air breaks.

Figure 2:
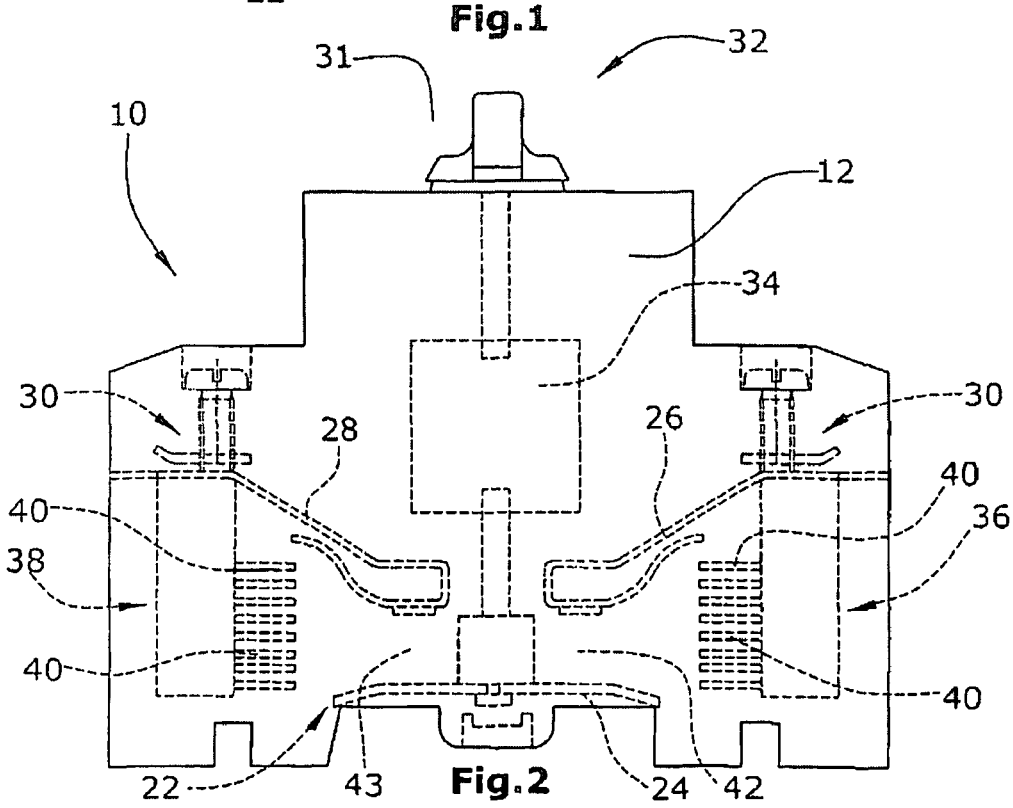
FIG. 2 shows a side view similar to that of FIG. 1, but with the movable switching contact elements in their open position in accordance with an aspect of the present invention.
Figure 3:
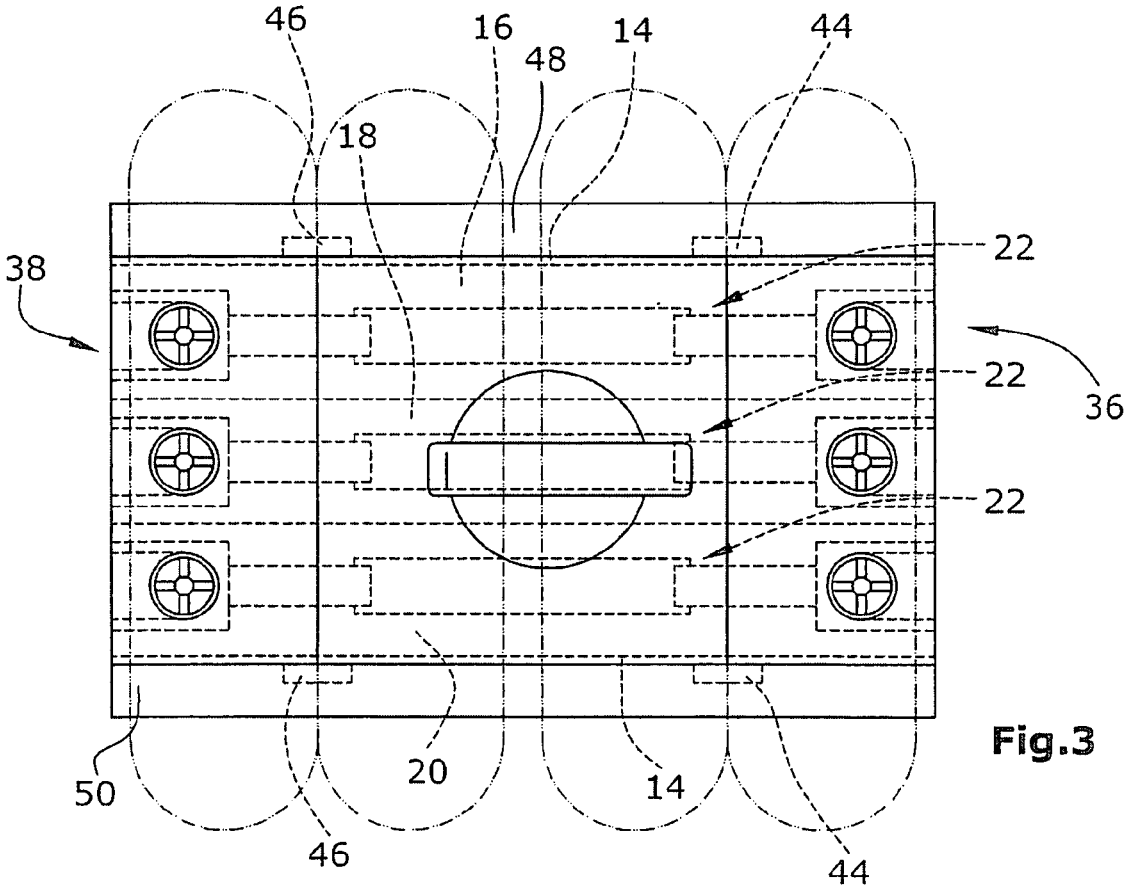
FIG. 3 shows a top view of the switching device housing shown in FIGS. 1 and 2, whereby an additional element is arranged to the side of each of the two opposite side walls of the housing, each of these elements having two permanent magnets in accordance with an aspect of the present invention.
Figure 4:
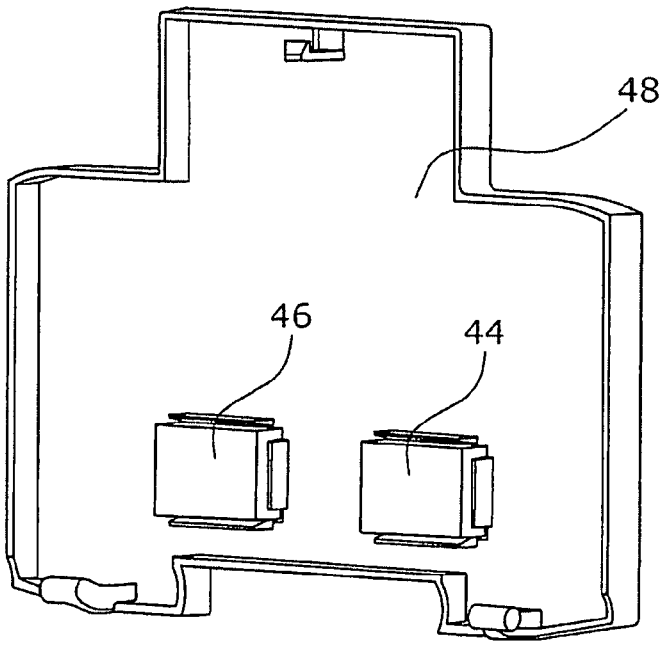
FIG. 4 a perspective view of one of the side elements shown in FIG. 3 in accordance with an aspect of the present invention.
Figure 5:
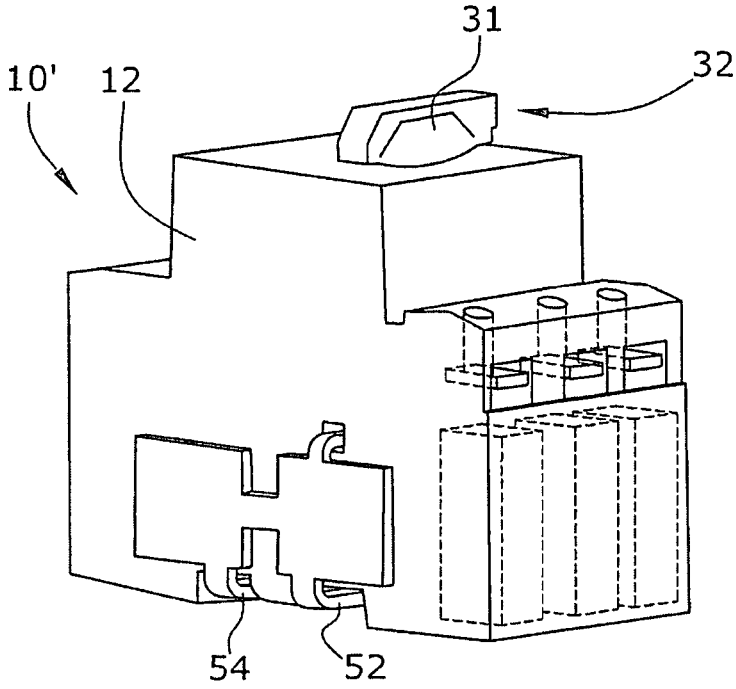
FIG. 5 a perspective view of an alternatively configured switching device for direct-current applications in which the external magnets are magnetically coupled via magnetic return elements in accordance with an aspect of the present invention.
Figure 6:
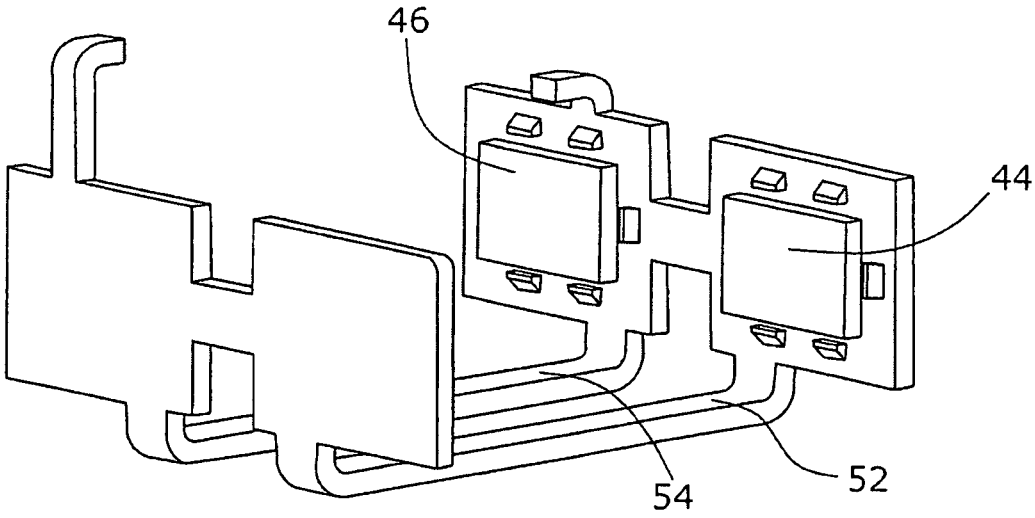
FIG. 6 a perspective view of the magnet arrangement with magnetic return elements, as employed in the embodiment of the switching device housing shown in FIG. 5 in accordance with an aspect of the present invention.

FIGS. 5 and 6 show a switching device 10' that has been modified in comparison to the embodiment shown in FIGS. 1 to 4; its housing 12 is constructed and configured as depicted in FIGS. 1 to 3 and has alternatively configured external first and second magnets 44, 46. To the extent that the individual components of the housing 12 shown in FIGS. 5 and 6 are the same or have the same function as the individual components of the switching device 10 shown in FIGS. 1 to 4, they have been given in FIGS. 5 and 6 the same reference numerals as in FIGS. 1 to 4. Thus, FIGS. 5 and 6 show that the two first magnets 44 and the two second magnets 46 are magnetically coupled to each other via magnetic return elements 52, 54, which translates into an amplification of the magnetic field between the first and second magnets 44, 46 that are opposite from each other. Therefore, this results in an amplified magnetic field that runs crosswise to the first or second air breaks 42, 43, which accounts for an improved or enhanced arc-quenching function or which makes it possible to employ smaller magnets 44, 46 to achieve the same arc-quenching function as in the embodiment shown in FIGS. 1 to 4.

Figure 7:
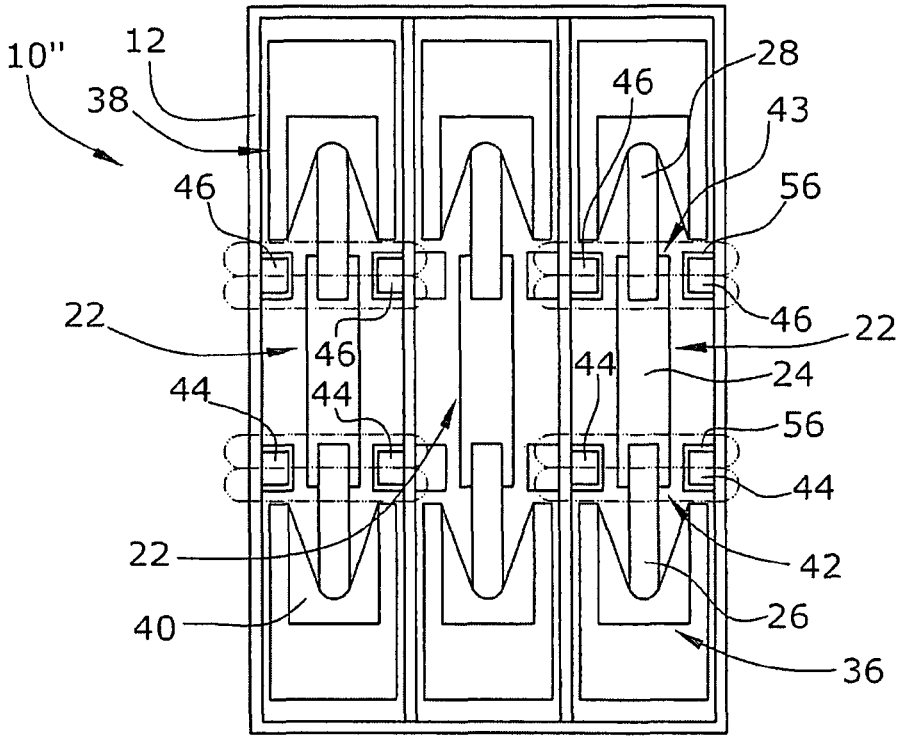
FIG. 7 a top view of another embodiment of an alternating-current switching device housing that has been modified for use as a direct-current switching device housing in accordance with an aspect of the present invention.

FIG. 7 shows a top view of the housing 12 of a modified switching device 10", with the upper part removed and with a modification for direct-current applications. To the extent that the individual components of the housing 12 shown in FIG. 7 are the same or have the same function as the individual components of the switching device 10 shown in FIGS. 1 to 4, they have been given in FIG. 7 the same reference numerals as in FIGS. 1 to 4.

Fundamentally, the housing 12 shown in FIG. 7 is structured in a similar way as depicted in FIGS. 1 to 3. In addition, the housing 12 as shown in FIG. 7 has receiving spaces 56 that are associated with the air breaks 42, 43 and are arranged on both sides of these air breaks. In an alternating-current switching device, these receiving spaces 56 serve to receive self-magnetic field amplifying elements of the type needed for smaller short-circuit currents in alternating-current switching devices in order to deflect the arcs into the arc-quenching device, where the arc is then quenched. For purposes of using or adapting the alternating-current device housing 12 for direct-current applications, the magnetic-field amplifying elements are removed so that the receiving spaces 56 are then free to receive the magnets 44, 46. In this context, diverging from what is shown in FIG. 7, it is possible that, for instance, the center current path 22 is removed, so that the switching device 10" can be employed as a two-pole direct-current switching device.

At this juncture, it should be pointed out that the three current paths of the switching devices 10, 10' and 10" can be connected in series (by means of external electric conductors, not shown in the figures) in order to function as a one-pole switching device with a total of six air breaks. By the same token, however, it is also conceivable to make use of only two of the three potentially possible current paths in order to implement a two-pole direct-current switching device. In the case of a four-pole alternating-current switching device that is to be modified for direct-current applications, all four current paths can be connected in series or else only two of the current paths can be employed as a two-pole direct-current switching device.

Figure 8:
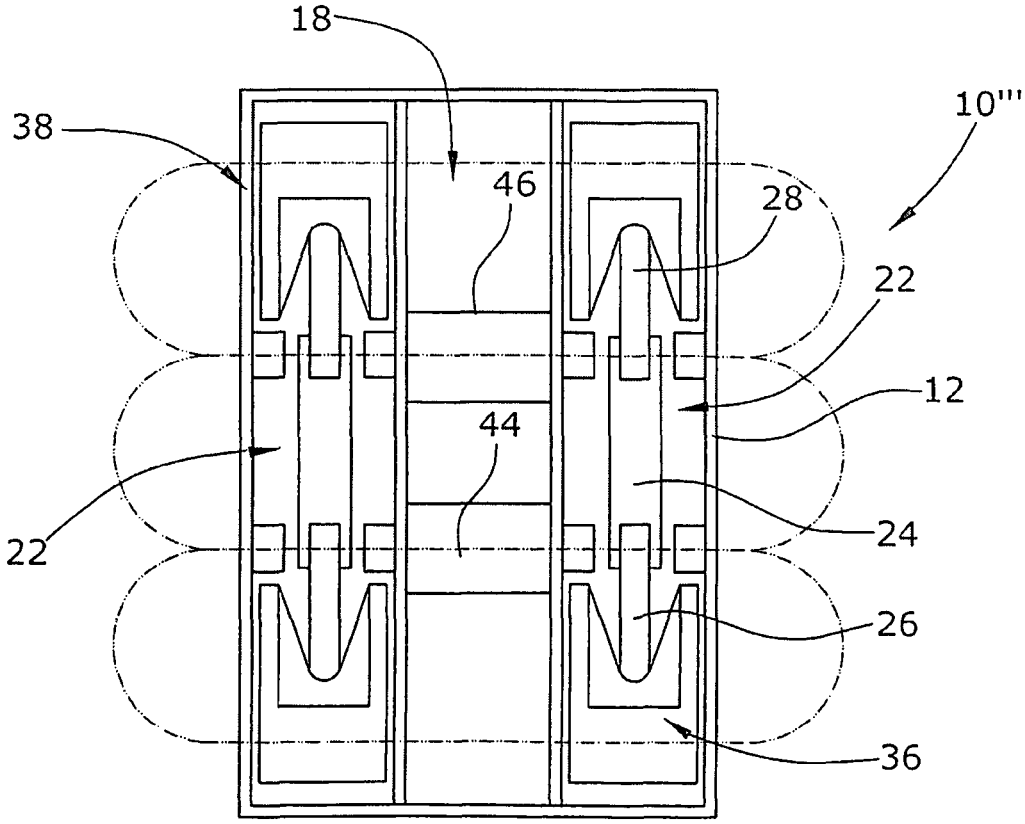
FIG. 8 a top view similar to that of FIG. 7, whereby an alternatively configured alternating-current switching device housing is shown that has been modified for use as a direct-current switching device in accordance with an aspect of the present invention.

FIG. 8 shows another embodiment of a direct-current switching device 10'" that is constructed on the basis of an alternating-current switching device housing 12. Regarding FIG. 8, it also applies that those individual components of the switching device housing 12 that have the same function or are constructed in the same manner as the elements of the switching device housing 12 shown in FIGS. 1 to 3 have been given the same reference numerals.

Diverging from the embodiment shown in FIGS. 1 to 3, the embodiment in FIG. 8 does not have the center current path 22, that is to say, the center receiving area 18 is free of a current path 22 and especially free of the movable switching contact element 24. FIG. 8 also shows that the center receiving area 18 does not have any arc-quenching devices. Consequently, the center receiving area 18 can now be employed to receive the first and second magnets 44, 46 that are arranged in the center receiving area 18 at the height of the air breaks 42 or 43 of the current paths 22 of the adjacent receiving areas 16 and 20.

The advantages of the use according to the present invention of conventional alternating-current switching devices for direct-current applications can be seen in the minor modification of the conventional alternating-current switching devices that can be manufactured in large production runs and thus cost-effectively, as well as in the associated inexpensive manufacture of direct-current switching devices (low investment in terms of time and development work for the modification as well as no need to conduct one's own development work for a purely direct-current switching device).

The present invention is not limited to the embodiments described herein, and reference should be had to the appended claims.

The invention claimed is:

1. A switching device for direct-current applications, comprising:

a housing having a first wall and a second wall disposed opposite each other;

at least three receiving areas configured for respective mutually substantially parallel current paths, the receiving areas being disposed next to each other in the housing successively between the first and second walls, at least two of the receiving areas each including a respective one of the current paths, each of the current paths having a respective stationary switching contact element and a respective movable switching contact element, the movable switching element being actuatable into a closed position so that the movable switching element is in contact with the respective stationary switching contact, and into an open position so as to form a respective air break so that an arc extending along the air break is formable, the respective movable switching contact elements being actuatable simultaneously between the open position and the closed position;

a plurality of arc-quenching devices associated with the current paths and disposed next to each other between the first and the second walls; and at least one magnet disposed on an outside of at least one of the first and second walls, the at least one magnet being configured to generate a magnetic field having magnetic field lines in a direction crosswise to the respective air breaks so as to generate a deflection force on each of the arcs so as to deflect the respective arcs toward at least one of the respective arc-quenching devices.

2. The switching device as recited in claim 1, wherein the at least one magnet is magnetically coupled to a magnetic return element that extends from the first wall to the second wall along an exterior of the housing.

3. The switching device as recited in claim 1, wherein the at least one magnet is disposed on an exterior of the first and second walls.

4. The switching device as recited in claim 2, wherein the at least one magnet includes first and second magnets coupled via the magnetic return element.

5. The switching device as recited in claim 1, wherein each of the current paths includes a second stationary switching contact element disposed opposite the stationary switching contact element so as to form a first respective air break between the stationary switching contact element and the movable switching contact element and a second respective air break between the second stationary switching contact element and the movable switching contact element, wherein the plurality of arc-quenching devices includes a first arc-quenching device associated with the first respective air breaks and a second arc-quenching device associated with the second respective air breaks, and wherein the at least one magnet includes a first magnet and a second magnet, the first magnet configured to generate a first magnetic field having magnetic field lines in a direction crosswise to each of the respective first air breaks so as to generate a first deflection force so as to deflect arcs formed along the respective first air breaks towards the first arc-quenching device and the second magnet configured to generate a second magnetic field having magnetic field lines in a direction crosswise to the second air break so as to generate a second deflection force so as to deflect arcs formed along the respective second air breaks towards the second arc-quenching device.

6. The switching device as recited in claim 5, wherein the at least one magnet includes a pair of first magnets and a pair of second magnets, wherein one first magnet and one second magnet are disposed on each of the first wall and the second wall, wherein the pair of first magnets are magnetically coupled via a first magnetic return element and the pair of second magnets are magnetically coupled via a second magnetic return element.

7. The switching device as recited in claim 5, wherein the at least one magnet includes a pair of first magnets and a pair of second magnets, wherein one first magnet and one second magnet are disposed on each of the first wall and the second wall, wherein the pair of first magnets and the pair of second magnets are magnetically coupled via a shared magnetic return element.

8. A switching device for direct-current applications, comprising:

a housing having a first wall and a second wall disposed opposite each other;

at least three receiving areas configured for respective mutually substantially parallel current paths, the receiving areas being disposed next to each other in the housing successively between the first and second walls, at least two of the receiving areas each including a respective one of the current paths and at least one of the receiving areas being a free receiving area that is free of a current path, each of the current paths having a respective stationary switching contact element and a respective movable switching contact element, the movable switching element being actuatable into a closed position so that the movable switching element is in contact with the respective stationary switching contact, and into an open position so as to form a respective air break so that an arc extending along the air break is formable, the respective movable switching contact elements being actuatable simultaneously between the open position and the closed position;

a plurality of arc-quenching devices associated with the current paths and disposed next to each other between the first and the second walls; and at least one magnet disposed in the free receiving area, the at least one magnet being configured to generate a magnetic field having magnetic field lines in a direction crosswise to the respective air breaks so as to generate a deflection force on the arcs so as to deflect the respective arcs toward at least one of the respective arc-quenching devices.

9. The switching device as recited in claim 8, wherein each of the current paths includes a second stationary switching contact element disposed opposite the stationary switching contact element so as to form a first respective air break between the stationary switching contact element and the movable switching contact element and a second respective air break between the second stationary switching contact element and the movable switching contact element, wherein the plurality of arc-quenching devices includes a first arc-quenching device associated with the first respective air breaks and a second arc-quenching device associated with the second respective air breaks, wherein the at least one magnet includes a first magnet and a second magnet, the first magnet configured to generate a first magnetic field having magnetic field lines in a direction crosswise to each of the respective first air breaks so as to generate a first deflection force so as to deflect arcs formed along the respective first air breaks towards the first arc-quenching device and the second magnet configured to generate a second magnetic field having magnetic field lines in a direction crosswise to the second air break so as to generate a second deflection force so as to deflect arcs formed along the respective second air breaks towards the second arc-quenching device.

10. A switching device for direct-current applications, comprising:

a housing having a first wall and a second wall disposed opposite each other;

at least three receiving areas configured for respective mutually substantially parallel current paths, the receiving areas being disposed next to each other in the housing successively between the first and second walls, at least two of the receiving areas each including a respective one of the current paths, each of the current paths having a respective stationary switching contact element and a respective movable switching contact element, the movable switching element being actuatable into a closed position so that the movable switching element is in contact with the respective stationary switching contact, and into an open position so as to form a respective air break so that an arc extending along the air break is formable, the respective movable switching contact elements being actuatable simultaneously between the open position and the closed position;

a plurality of arc-quenching devices associated with the current paths and disposed next to each other between the first and the second walls;

a plurality of receiving spaces formed adjacent to the movable switching contact element and the stationary switching contact element and disposed within the housing, the plurality of receiving spaces configured for magnetic-field amplifying elements configured to amplify a magnetic field associated with the arc formed along the air break; and at least one magnet disposed in at least one of the plurality of receiving spaces, the at least one magnet being configured to generate a magnetic field having magnetic field lines in a direction crosswise to the respective air breaks so as to generate a deflection force on the arcs so as to deflect the arcs toward at least one of the respective arc-quenching devices.

11. The switching device as recited in claim 10, wherein each of the current paths includes a secondary stationary switching contact element disposed opposite the stationary switching contact element so as to form a first respective air break between the stationary switching contact element and the movable switching contact element and a second respective air break between the second stationary switching contact element and the movable switching contact element, wherein the plurality of arc-quenching devices includes a first arc-quenching device associated with the first respective air breaks and a second arc-quenching device associated with the second respective air breaks, wherein the at least one magnet includes a first magnet and a second magnet, the first magnet configured to generate a first magnetic field having magnetic field lines in a direction crosswise to each of the respective first air breaks so as to generate a first deflection force so as to deflect arcs formed along the respective first air breaks towards the first arc-quenching device and the second magnet configured to generate a second magnetic field having magnetic field lines in a direction crosswise to the second air break so as to generate a second deflection force so as to deflect arcs formed along the respective second air break towards the second arc-quenching device.

12. A switching device for direct-current applications, comprising:

a housing having a first wall and a second wall disposed opposite each other;

at least three receiving areas configured for respective mutually substantially parallel current paths, the receiving areas being disposed next to each other in the housing successively between the first and second walls, at least two of the receiving areas each including a respective one of the current paths and at least one of the receiving areas being a free receiving area that is free of a current path, each of the current paths having a respective stationary switching contact element and a respective movable switching contact element, the movable switching element being actuatable into a closed position so that the movable switching element is in contact with the respective stationary switching contact, and into an open position so as to form a respective air break so that an arc extending along the air break is formable, the respective movable switching contact elements being actuatable simultaneously between the open position and the closed position;

a plurality of arc-quenching devices associated with the current paths and disposed next to each other between the first and the second walls;

at least one external magnet disposed on an outside of at least one of the first and second walls; and at least one internal magnet disposed in the free receiving area, wherein the at least one external magnet and the at least one internal magnet are configured to generate a magnetic field having magnetic field lines in a direction crosswise to the respective air breaks so as to generate a deflection force on the arcs so as to deflect the respective arcs toward at least one of the respective arc-quenching devices.

13. A switching device for direct-current applications, comprising:

a housing having a first wall and a second wall disposed opposite each other;

at least three receiving areas configured for respective mutually substantially parallel current paths, the receiving areas being disposed next to each other in the housing successively between the first and second walls, at least two of the receiving areas each including a respective one of the current paths, each of the current paths having a respective stationary switching contact element and a respective movable switching contact element, the movable switching element being actuatable into a closed position so that the movable switching element is in contact with the respective stationary switching contact, and into an open position so as to form a respective air break so that an arc extending along the air break is formable, the respective movable switching contact elements being actuatable simultaneously between the open position and the closed position;

a plurality of arc-quenching devices associated with the current paths and disposed next to each other between the first and the second walls; and a plurality of receiving spaces formed adjacent to the movable switching contact element and the stationary switching contact element and disposed within the housing, the plurality of receiving spaces configured for magnetic-field amplifying elements configured to amplify a magnetic field associated with the arc formed along the air break;

at least one external magnet disposed on an outside of at least one of the first and second walls; and at least one internal magnet disposed in at least one of the plurality of receiving spaces, wherein the at least one external magnet and the at least one internal magnet are configured to generate a magnetic field having magnetic field lines in a direction crosswise to the respective air breaks so as to generate a deflection force on the arcs so as to deflect the respective arcs toward at least one of the respective arc-quenching devices.

14. The switching device as recited in claim 1, further comprising a breaker latch configured to simultaneously actuate the respective movable switching contact elements.

15. The switching device as recited in claim 1, wherein the at least one magnet includes a permanent magnet.

16. The switching device as recited in claim 1, wherein the first and second arc-quenching devices each include a plurality of arc-quenching plates disposed vertically forming an arc-quenching chamber.

* * * * *